US006915822B2

(12) United States Patent
Krumm

(10) Patent No.: US 6,915,822 B2
(45) Date of Patent: Jul. 12, 2005

(54) FABRIC SPREADER WITH A LIGHTWEIGHT HOLLOW METAL SPREADER ROD FOR A LOOM

(75) Inventor: Valentin Krumm, Hergensweiler (DE)

(73) Assignee: Lindauer DORNIER Gesellschaft mbH, Lindau (DE)

( * ) Notice: Subject to any disclaimer, the term of this patent is extended or adjusted under 35 U.S.C. 154(b) by 88 days.

(21) Appl. No.: 10/387,889

(22) Filed: Mar. 12, 2003

(65) Prior Publication Data

US 2003/0172984 A1 Sep. 18, 2003

(30) Foreign Application Priority Data

Mar. 14, 2002 (DE) ..... 102 11 149

(51) Int. Cl.[7] ..... D03J 1/22
(52) U.S. Cl. ..... 139/294; 139/295; 139/296
(58) Field of Search ..... 139/294, 295, 139/296, 304, 311, 312

(56) References Cited

U.S. PATENT DOCUMENTS

| | | | |
|---|---|---|---|
| 2,434,820 | A | 1/1948 | Tifft |
| 4,276,911 | A | 7/1981 | Pfarrwaller |
| 4,919,171 | A | 4/1990 | Dornier |
| 5,305,803 | A | 4/1994 | Steinberger |

FOREIGN PATENT DOCUMENTS

| | | |
|---|---|---|
| CH | 252997 | 2/1948 |
| CH | 252997 | * 11/1948 |
| DE | 2304099 | 9/1973 |
| DE | 2243669 | 3/1974 |
| DE | 2854256 | 6/1980 |
| DE | 19538137 | 2/1997 |
| EP | 0336409 | 10/1989 |

* cited by examiner

*Primary Examiner*—John J. Calvert
*Assistant Examiner*—Andrew W. Sutton
(74) *Attorney, Agent, or Firm*—W. F. Fasse; W. G. Fasse

(57) ABSTRACT

A fabric spreader arrangement for a loom includes a spreader rod rotatably received in a hollow space of a spreader body. The fabric is looped around the spreader rod in the hollow space. To achieve a low wear, a light weight, and an excellent fabric spreading effect, the spreader rod is a one-piece hollow cylindrical metal body extending entirely over the weaving width, preferably made of V4A stainless steel, having an outer diameter of at least 10 mm (and preferably 15 mm) with a wall thickness of at least 0.4 mm (and preferably 0.7 mm), and having an outer circumferential surface that has been surface treated to achieve a surface roughness with a peak-to-valley roughness measurement of at least 10 $\mu$m (and preferably 20 to 50 $\mu$m).

10 Claims, 1 Drawing Sheet

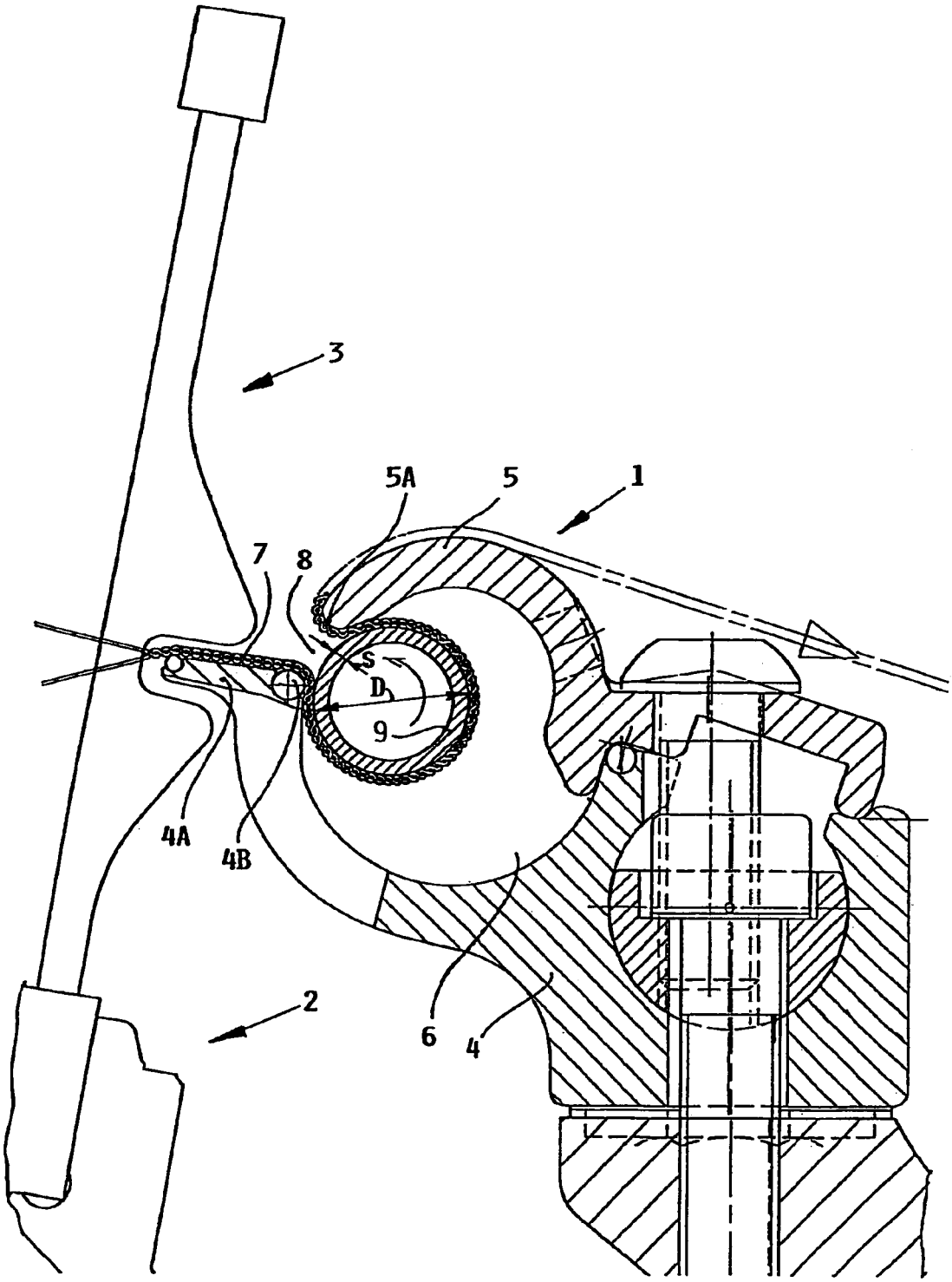
3
5A
5
1
7
8
S
D
9
4A
4B
2
6
4

FABRIC SPREADER WITH A LIGHTWEIGHT HOLLOW METAL SPREADER ROD FOR A LOOM

PRIORITY CLAIM

This application is based on and claims the priority under 35 U.S.C. §119 of German Patent Application 102 11 149.9, filed on Mar. 14, 2003, the entire disclosure of which is incorporated herein by reference.

FIELD OF THE INVENTION

The invention relates to a spreader arrangement for spreading, in the weaving width direction, the woven fabric being produced on a loom.

BACKGROUND INFORMATION

It is generally known in the art to provide a spreader arrangement in a loom, downstream of the beat-up and interlacing point, for spreading the width of the woven fabric that is being produced, so as to prevent the fabric from contracting in the widthwise direction. Various configurations of such spreader arrangements are known. For example, it is known to provide a fabric spreader body that substantially encloses a hollow space therein, and that has two fabric deflection elements with an open fabric slot therebetween, which communicates into the hollow space. The fabric spreader body extends in the weaving width direction at least over the entire width of the woven fabric that is to be produced. A rotationally symmetric spreader element or spreader rod having a defined diameter is received rotatably in the hollow space of the spreader body, and the woven fabric is directed or threaded over the first fabric deflection element through the slot and into the hollow space, around a portion of the circumference of the spreader rod, then back through the fabric slot and over the second fabric deflection element. The open or clear spacing width of the fabric slot between the two fabric deflection elements may be smaller than the outer diameter of the spreader rod, so as to retain the spreader rod in the hollow space of the spreader body, while the spreader rod is carried or guided by the fabric passing therearound.

Fabric spreader arrangements of the above described general type are known from various publications, for example from the Patent Publications CH 252,997, DE 22 43 669 C2, EP 0,336,409 B1, and U.S. Pat. No. 5,305,803. Such fabric spreader arrangements are also known as spreader tables, fabric temples, and fabric expander arrangements.

It is known in practice to construct the rotating fabric spreader element or spreader rod as a rotationally symmetrical solid metal rod having a rubber or rubbery elastomeric coating on the outer circumferential surface thereof. Such rubber-coated solid metal spreader rods are relatively heavy and have thus been found unsatisfactory in their operation and in their handling in connection with the operation and equipping of a modern high speed loom. It is further known to make the spreader element of a solid polymer material, for example with a profiled or textured circumferential surface. In practice, both the rubber-coated metal spreader rods as well as the solid polymer spreader rods suffer the disadvantage of a relatively high degree and rate of wear, which leads to a relatively short operating life. In order to maintain satisfactory operation, it thus becomes necessary to frequently replace the spreader rod, which leads to increased loom operating costs.

SUMMARY OF THE INVENTION

In view of the above, it is an object of the invention to provide an improved spreader element for a fabric spreader arrangement of the above described general type, which achieves an extremely good fabric spreading effect over the entire weaving width, while being relatively light in weight, resistant to wear, and durable for a long operating life, and which is useable for all high quality woven fabrics. The invention further aims to avoid or overcome the disadvantages of the prior art, and to achieve additional advantages, as apparent from the present specification.

The above objects have been achieved according to the invention in a fabric spreader arrangement of the above described general type, in which particularly the spreader element comprises a spreader rod in the form of a unitary or one-piece hollow cylindrical metal body that extends longitudinally along the weaving width of the woven fabric being produced and that has an outer circumferential surface with a surface characteristic achieved by a surface treatment thereof. Namely, the surface has a certain specified texture or roughness.

More particularly and preferably according to the invention, the hollow cylindrical metal spreader rod consists entirely of V4A stainless steel, has an outer diameter of at least 10 mm with a wall thickness of at least 0.4 mm, preferably a wall thickness of 0.7 mm for an outer diameter of 15 mm. Further preferably, the wall thickness does not exceed 6% or especially does not exceed 5% of the outer diameter of the spreader rod. For example, the wall thickness can be limited to not more than 1.2 mm in typical embodiments. Thereby, the hollow spreader rod is quite thin-walled, is very lightweight, and has a low moment of inertia with respect to its free rotation, yet is still sufficiently strong and stiff over the weaving width to carry out its intended function and operation. Making the wall thickness greater would unnecessarily increase the cost, weight and rotational inertia, while detracting from the best operability of the spreader rod.

The outer circumferential surface of the metal spreader rod, which comes directly into contact with the woven fabric, has a surface roughness characteristic with a peak-to-valley height of at least 10 $\mu$m, preferably a surface roughness of from 20 to 50 $\mu$m. This surface roughness provides good engagement between the woven fabric and the spreader rod, so that the spreader rod exerts a good spreading effect, without requiring needles, pins, or the like which would penetrate the fabric. Instead, there is merely a surface frictional contact engagement between the fabric and the spreader rod. It has been found that a surface roughness below 10 $\mu$m does not provide a sufficient frictional engagement with the fabric, while a surface roughness greater than 50 $\mu$m does not provide any operational benefit, is more difficult to provide, and can even provide worse operating characteristics. The specified micro-roughness finish can be provided on the spreader rod by subjecting the circumferential surface thereof to any suitable known metal surface treatment, such as mechanical embossing, mechanical grinding, grit blasting, chemical etching, electro-spark or plasma treatments, etc.

BRIEF DESCRIPTION OF THE DRAWINGS

In order that the invention may be clearly understood, it will now be described in detail in connection with an example embodiment, with reference to the single drawing FIGURE schematically showing a cross-section through a fabric spreader arrangement according to the invention for use in an air jet loom.

DETAILED DESCRIPTION OF A PREFERRED EXAMPLE EMBODIMENT AND OF THE BEST MODE OF THE INVENTION

The present example embodiment of a fabric spreader arrangement 1 or spreader table 1 according to the invention is to be arranged in a generally conventional manner in a loom, such as an air jet loom. The single drawing FIGURE schematically shows a partially sectioned side view of the inventive fabric spreader arrangement 1 arranged in connection with the weaving reed 3 carried by a reed support 2, e.g. reed batten or sley 2 in an air jet loom.

The fabric spreader arrangement 1 comprises a fabric spreader body structure that includes a fabric spreader body 4 and a cover 5, as well as a spreader rod 9. The spreader body 4 is releasably or removably connected to the machine frame of the loom, for example by bolts as schematically shown. The spreader body 4 has a length that extends along the maximum weaving width of the loom. The removable cover 5 is removably secured relative to the spreader body 4, for example also by bolts or the like. The removable cover 5 and the spreader body 4 together form the body structure that substantially encloses a hollow space 6, which is generally or roughly cylindrical in shape and extends longitudinally along the length of the spreader body 4 and cover 5, i.e. in the weaving width direction.

Pointing in the upstream direction against the fabric advance direction, i.e. toward the fabric beat-up and interlacing point, the spreader body 4 includes a spreader projection or lip 4A having a flat planar support surface or table for supporting and guiding the woven fabric 7 as it is produced at the beat-up and interlacing point. At the rear edge of this spreader projection or lip 4A, adjacent to the hollow space 6, the spreader body 4 has a first fabric deflection element 4B, which may simply be a rounded edge of the projection 4A, or a rounded insert of a low friction material, or a roller, or the like. The upstream free edge of the cover 5 is similarly provided with a second fabric deflection element 5A.

A fabric slot 8 is formed and bounded between the first fabric deflection element 4B and the second fabric deflection element 5A, and extends longitudinally along the length of the spreader body 4 and cover 5, i.e. entirely along the weaving width. This fabric slot 8 has a clear open width or clearance between the two fabric deflection elements 4B and 5A, which is set smaller than the outer diameter D of the spreader rod 9, which is rotatably received in the hollow space 6. Thereby, the spreader rod 9 is freely rotatable, yet is retained in the hollow space 6, while the fabric 7 passes over the first deflection element 4B through the slot 8 into the space 6, around most of the circumference of the spreader rod 9, and then back out through the slot 8 over the second deflection element 5A. This keeps the fabric 7 in snug engagement on the spreader rod 9, while the rod 9 is allowed to rotate as the fabric advances, i.e. is drawn off toward the right in the single FIGURE. The cover 5 can be removed when necessary to replace the spreader rod 9, for example.

According to the invention, the spreader rod 9 is especially embodied as a one-piece integral hollow cylindrical body that extends longitudinally entirely along the weaving width. This hollow cylindrical body consists of a metal, preferably V4A stainless steel, and is relatively lightweight, because it has a relatively small wall thickness, for example a wall thickness of 0.7 mm for an outer diameter D of 15 mm, in a preferred example. The outer diameter D is at least 10 mm, whereby the wall thickness s is at least 0.4 mm. Preferably, the wall thickness s does not exceed 5% of the outer diameter D.

Further according to the invention, the outer circumferential surface of the spreader rod 9 is subjected to a surface treatment to achieve a specified surface roughness with a peak-to-valley measurement (Rt) of at least 10 $\mu$m, and preferably 20 to 50 $\mu$m. With this surface roughness, it has surprisingly and unexpectedly been found that an excellent fabric spreading effect is achieved on the fabric 7 being produced, without causing any damage or impairment of the fabric quality. It is not necessary to provide spreader pins, needles or the like which penetrate the fabric to achieve a direct positive engagement of the spreader element with the fabric. Furthermore, running tests have shown that the spreader rod 9 according to the invention has a relatively long operating life due to a relatively low rate of wear, in comparison to existing prior art spreader rods.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A fabric spreader arrangement for spreading a woven fabric in a loom, comprising:

a spreader body structure that extends longitudinally along at least a weaving width in the loom, forms a hollow space extending longitudinally in said spreader body structure, and has opposed first and second fabric deflection elements which define an open fabric slot therebetween communicating into said hollow space; and a spreader rod that is rotatably arranged in said hollow space, extends longitudinally along said spreader body structure, and has an outer diameter larger than an open clearance of said fabric slot between said first and second fabric deflection elements;

wherein said spreader rod is a one-piece hollow cylindrical metal body that consists of stainless steel, extends longitudinally along at least the weaving width, and has an outer circumferential surface with a peak-to-valley surface roughness of at least 10 $\mu$m.

2. The fabric spreader arrangement according to claim 1, wherein said stainless steel is V4A stainless steel.

3. The fabric spreader arrangement according to claim 1, wherein said surface roughness is in a range from 20 $\mu$m to 50 m.

4. A The fabric spreader arrangement according to claim 1, wherein said outer diameter is 15 mm and said wall thickness is 0.7 mm.

5. The fabric spreader arrangement according to claim 1, wherein said spreader rod entirely and integrally consists of said stainless steel, and does not include a non-metal coating on or forming said outer circumferential surface.

6. The fabric spreader arrangement according to claim 1, wherein said wall thickness is not more than 6% of said outer diameter.

7. The fabric spreader arrangement according to claim 1, wherein said wall thickness is not more than 5% of said outer diameter.

8. The fabric spreader arrangement according to claim 1, wherein said wall thickness is not greater than 1.2 mm.

9. A fabric spreader arrangement for spreading a woven fabric in a loom, comprising:

a spreader body structure that extends longitudinally along at least a weaving width in the loom, forms a hollow space extending longitudinally in said spreader body structure, and has opposed first and second fabric deflection elements which define an open fabric slot therebetween communicating into said hollow space; and a spreader rod that is rotatably arranged in said hollow space, extends longitudinally along said spreader body structure, and has an outer diameter larger than an open clearance of said fabric slot between said first and second fabric deflection elements;

wherein said spreader rod is a hollow cylindrical body consisting entirely of metal, extending longitudinally along at least the weaving width, having said outer diameter being at least 10 mm with a wall thickness that is at least 0.4 mm and not greater than 6% of said outer diameter, and having an outer circumferential surface with a peak-to-valley surface roughness of at least 10 $\mu$m and not greater than 50 $\mu$m.

10. The fabric spreader arrangement according to claim 1, wherein said outer diameter is at least 10 mm with a wall thickness of at least 0.4 mm.

* * * * *

UNITED STATES PATENT AND TRADEMARK OFFICE

CERTIFICATE OF CORRECTION

PATENT NO. : 6,915,822 B2
DATED : July 12, 2005
INVENTOR(S) : Krumm

It is certified that error appears in the above-identified patent and that said Letters Patent is hereby corrected as shown below:

Title page,
Item [30], Foreign Application Priority Data, replace “102 11 149” by -- 102 11 149.9 --.

Column 2,
Line 54, after “specified” replace “micro-roughness” by -- micro-roughened --.

Column 3,
Line 65, after “thickness” insert -- s --.

Column 4,
Line 50, replace “50 m” by -- 50$\mu$m --.
Line 51, before “The fabric” delete “A”.

Signed and Sealed this

Thirteenth Day of December, 2005

JON W. DUDAS
*Director of the United States Patent and Trademark Office*